US006750001B2

(12) United States Patent
Ikeda et al.

(10) Patent No.: US 6,750,001 B2
(45) Date of Patent: Jun. 15, 2004

(54) SILVER HALIDE COLOR PHOTOGRAPHIC MATERIAL

(75) Inventors: Tsuyoshi Ikeda, Hino (JP); Kazuhiro Miyazawa, Hino (JP); Hirokazu Sato, Hino (JP); Motoi Nishimura, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/331,311

(22) Filed: Dec. 30, 2002

(65) Prior Publication Data

US 2003/0180671 A1 Sep. 25, 2003

(30) Foreign Application Priority Data

Jan. 9, 2002 (JP) ..... 2002/002278
Jan. 9, 2002 (JP) ..... 2002/002279
Jan. 10, 2002 (JP) ..... 2002/003364

(51) Int. Cl.[7] ..... G03C 1/46; G03C 1/08; G03C 7/32

(52) U.S. Cl. ..... 430/505; 430/502; 430/503; 430/546

(58) Field of Search ..... 430/505, 502, 430/503, 546

(56) References Cited

U.S. PATENT DOCUMENTS 2,458,437 A 1/1949 Smith
5,514,527 A * 5/1996 Abe et al. ..... 430/503
5,538,839 A * 7/1996 Abe et al. ..... 430/503
6,235,455 B1 * 5/2001 Ito et al. ..... 430/362
6,399,289 B1 * 6/2002 Hosokawa et al. ..... 430/546
6,503,695 B1 * 1/2003 Miyazawa et al. ..... 430/505

FOREIGN PATENT DOCUMENTS

| | | |
|---|---|---|
| EP | 0668535 | 8/1995 |
| EP | 1048976 | 11/2000 |
| EP | 1098221 | 5/2001 |
| JP | 3158847 | 8/1991 |

OTHER PUBLICATIONS

European Search Report EP 03 25 0054.

* cited by examiner

*Primary Examiner*—Geraldine Letscher
(74) *Attorney, Agent, or Firm*—Muserlian, Lucas and Mercanti

(57) ABSTRACT

A silver halide color photographic material is disclosed, comprising support having thereon a yellow image forming layer, a magenta image forming layer and a cyan image forming layer, each of which contains light sensitive silver, halide, wherein when the photographic material having been exposed to light for $10^{-10}$ to $10^{-3}$ sec. per pixel and processed, an effective tone range of a color image obtained in each of the color image forming layers is 0.65 to 0.84.

7 Claims, No Drawings

SILVER HALIDE COLOR PHOTOGRAPHIC MATERIAL

FIELD OF THE INVENTION

The present invention relates to a silver halide color photographic material, which is exposed based on digital information and processed to prepare a color print, and an image forming method by the use thereof, and in particular to a silver halide color photographic material exhibiting enhanced character reproduction and capable of stably reproducing prints having reduced scanning unevenness in scene images even when exposed in various digital exposure apparatuses having different exposure light sources and exposure systems, and also capable of obtaining prints exhibiting little variation in density even when the time after completion of exposure and before the start of processing is varied; and an image forming method by use thereof.

BACKGROUND OF THE INVENTION

In recent years, opportunities of treating images as digital data have rapidly increased along with enhancement of operation capacity and progress in network technology. Image information obtained by digital cameras or image information which has been digitized from photographic film or prints using a scanner can be readily edited or added with characters or illustrations on a computer. Examples of hard copy material used for prepare a hard copy based on such digitized image information include a sublimation type thermal print, melt type thermal print, ink-jet print, electrostatic transfer type print, thermo-autochrome print and silver halide color photographic material. Of these, silver halide color photographic material (hereinafter, also referred to as photographic material) has greatly superior characteristics such as high sensitivity, superior tone, superior image lasting quality and lower cost, compared to other print material and therefore, is broadly employed for preparation of high quality hard copy prints.

Digitized image information can be readily edited on a computer, leading to increased opportunities of treating images comprised of a mixture of images based on photography data of people, landscapes, still-life and the like (hereinafter, also denoted as scenic images) and character images (specifically, thin small black text). Accordingly, reproduction of natural scenic images and character reproduction without blurring are simultaneously required in image output based on digital data.

Various types of digital exposure apparatuses performing exposure based on digitized image information are now commercially available and many kinds of models of digital exposure apparatuses have also been developed along with progresses in exposure light sources and exposure control apparatuses. Of these digital exposure apparatuses, apparatuses using a light source having a narrow wavelength distribution, such as laser or LED are becoming the main trend. However, the kind of lasers or LED installed in various types of digital exposure apparatuses is not unified and the exposure wavelength is often different for every exposure apparatus. Furthermore, even in cases where using the same light source, there are often differences in overlapping ratio of exposure beams, exposure time interval between adjacent picture elements (hereinafter, also denoted as pixels) and exposure time or intensity per pixel. Consequently, different exposure apparatuses often result in variation in reproduced print quality and consequently improvement thereof is strongly desired.

Of digital exposure systems, a scanning exposure system using an exposing light beam is known as one of the more popular exposure systems. In this system, there is known a system using the combination of plural light sources having the same color (hereinafter, such a system is also an array exposure system). In the case of the array exposure system, however, the operation of canceling exposure streaks often takes a bit of doing, compared to an exposure system using a single light source and improvement thereof is also desired. An array block in which plural pixels are simultaneously exposed is a popular embodiment, leading to cases in which adjacent pixels are simultaneously exposed in the array block and cases in which adjacent pixels are exposed at different timing with undergoing transport of the photographic material or movement of the exposure head therebetween. Specifically in cases where time intervals between the adjacent pixels are different, photographic material having stable characteristic with little variation in density has been desired to make an operation to cancel exposure streaks easier.

Furthermore, it is contemplated that an extremely short exposure time per pixel, such as $10^{-10}$ to $10^{-3}$ sec. per pixel results in a change in latent image forming efficiency or stability of formed latent images. Consequently, there occurs a phenomenon in which a change in interval between exposure and processing often causes variation in reproduced density (so-called latent-image shift) and improvement thereof has been sought.

Such problems may be overcome by optimization of photographic material for every exposure apparatus or every environment, however, this is not a realistic response in view of the numerous kinds of digital exposure apparatuses available on the market and the number of which will inevitably increase in the future. Accordingly, there have been photographic materials and image forming methods by which beautiful prints can be obtained, in which characters with sharp edges are reproduced without blurring nor streaking defects due to scanning exposure.

There have been proposed methods for enhancing image quality to overcome the foregoing problems. For example, JP-A No. 3-158847 (hereinafter, the term, JP-A is referred to as Japanese Patent Application Publication) discloses a method for controlling the average value of point gammas over a given density range and variation thereof. JP-A No. 8-36247 discloses a method in which the relationship of an instantaneous contrast value and an exposure amount is defined. JP-A No. 9-171237 discloses a method for enhancing the maximum gamma and fill-in Dmax within an exposure range to a given level or higher. JP-A No. 2000-321730 discloses controlling a density loss as a function of index color record lower in respective color forming layers over an exposure region of 1000 nano-sec. to 0.5 sec. to improve image quality over the broad exposure region. However, any of these methods aims mainly to enhance image quality and is silent with respect to stability in cases when the time after exposure and before the start of processing is varied.

SUMMARY OF THE INVENTION

Accordingly, it is an object of the invention to provide a silver halide color photographic material, which is exposed based on digital information and processed to prepare a color print, and an image forming method by the use thereof, and in particular to a silver halide color photographic material exhibiting enhanced character reproduction and capable of stably reproducing prints having reduced scanning unevenness in scene images even when exposed in various digital exposure apparatuses having different exposure light sources and exposure systems, and also capable of obtaining prints exhibiting little variation in density even when the time after exposure and before the start of processing is varied; and an image forming method by use thereof.

The foregoing object of the invention can be accomplished by the following constitution:

A silver halide color photographic material comprising a support having thereon at least a yellow image forming layer, at least a magenta image forming layer and at least a cyan image forming layer, each of which contains light sensitive silver halide, wherein when the photographic material having been exposed to light for $10^{-10}$ to $10^{-3}$ sec. per pixel and processed, an effective tone range (hereinafter, also denoted simply as VE) of a color image. obtained in each of the color image forming layers is 0.65 to

DETAILED DESCRIPTION OF THE INVENTION

One aspect of the invention is characterized in that when subjected to exposure to light so that the exposure time is $10^{-10}$ to $10^{-3}$ sec. per pixel, an effective tone range (VE) obtained after being subjected to color development is 0.65 to 0.84 in the respective color image forming layers.

In cases when image information is digitized, an original image is divided into squares and image information is usually digitized for every square. In this invention, when the original image information is divided into squares, the minimum unit thereof is referred to as one pixel. Accordingly, the exposure time per pixel can be supposed to be the time during which an intensity or the irradiation time of a light beam is controlled based on the digital data for one pixel.

As a result of study by the inventors of this application, it was proved that this exposure region greatly affects print image quality at the time digital exposure was made. Specifically in cases when an interval between exposure and processing (i.e., a time after completion of exposure and before start of processing) is varied, effects on blurring of character images and occurrence of scanning exposure streaks were proved to be marked.

In this invention, the effective tone range (also denoted simply as VE) is defined as an exposure region in which a point gamma is not less than 1.0 when outputting a gray scale on the photographic material relating to this invention. The effective tone range of this invention can be determined in the following manner.

Thus, using a laser scanning exposure apparatus which has been adjusted so that the exposure time per pixel is $10^{-10}$ to $10^{-3}$ sec. and overlap of light beam rasters falls within the range of 5 to 30%, a 1 cm square patch is exposed onto a photographic material with varying the exposure amount (i.e., the photographic material is exposed with varying the exposure amount so as to give 1 cm square patches having different gray densities). The thus exposed photographic material is processed using the following color developer (CDC-1) at a temperature of 37±0.50° C. for a period of 45 sec. (which is followed by conventional bleach-fixing and stabilization). In this invention, the time after completion of exposure and before start of development is one hour. Gray patches of the thus processed photographic material are measured with respect to reflection density to prepare a characteristic curve comprised of an ordinate of the reflection density (D) and an abscissa of the common logarithm of the exposure amount (Log E). Thus, a plot of the blue density against the common logarithm of the exposure amount necessary for dye-forming in a yellow image forming layer, the green density against the common logarithm of the exposure amount necessary for dye-forming in a magenta image forming layer, and the red density against the common logarithm of the exposure amount necessary for dye-forming in a cyan image forming layer are respectively prepared to form a characteristic curve. Differential value of density vs. logarithmic exposure amount for each step can be calculated on the characteristic curve to determine a point gamma value for each of the yellow, magenta and cyan image forming layers. The exposure region giving a point gamma of not less than 1.0, which is expressed in terms of logarithmic value (ΔLog E) is defined as the effective tone range for respective color image forming layers.

The point gamma of this invention, as described in T. H. James, The Theory of the Photographic Process, 4th edition, page 502, is defined as follows:

$$\text{point gamma } (p\text{-}\gamma)=dD/d \text{ Log } E$$

where D is a density and E is an exposure amount; that is, the point gamma is a differential value at an arbitrary point on the characteristic curve comprised of an ordinate of the density (D) and an abscissa of the common logarithm of the exposure amount (Log E).

| Color developing agent | |
|---|---|
| Water | 800 ml |
| Triethylenediamine | 2 g |
| Diethylene glycol | 10 g |
| Potassium bromide | 0.02 g |
| Potassium chloride | 4.5 g |
| Potassium sulfite | 0.25 g |
| N-ethyl-N-(β-methanesulfonamidoethyl)-3-ethyl-4-aminoaniline sulfate | 4.0 g |
| N,N-diethylhydroxylamine | 5.6 g |
| Triethanolamine | 10.0 g |
| Sodium diethylenetriaminepentaacetate | 2.0 g |
| potassium carbonate | 30 g |
| Water to make | 1 liter |

The pH is adjusted to 10.1 with sulfuric acid or potassium hydroxide.

In this invention, the diameter of a light beam (beam diameter) is to be the width of one raster. The beam diameter is defined as the diameter of a circle formed of points corresponding to the maximum value of light beam intensity (center of the light beam), multiplied by $e^{-2}$, which can be determined using, for example, a beam monitor having the combination of a slit and a power-meter.

One preferred embodiment of the invention is characterized in that of effective tone range (VE) values of respective color image forming layers, obtained after being subjected to exposure to light so that the exposure time is $10^{-10}$ to $10^{-3}$ sec per pixel and further subjected to color processing, the difference (ΔVE) between the maximum value of the effective tone range values ($VE_{max}$) for each of the color image forming layers and the minimum value the effective tone range values ($VE_{min}$) for each of the color image forming layers is not less than 0 and not more than 0.08, that is, $$0.00 \leqq \Delta VE(=VE_{max}-VE_{min}) \leqq 0.08.$$

In cases when the ΔVE value is small, balance between yellow, magenta and cyan images is suitably maintained, leading to reduced blurring on character fringes and reduced occurrence of scanning exposure streaks in a solid image.

One aspect of the invention is characterized in that when subjected to exposure to light so that the exposure time is $10^{-10}$ to $10^{-3}$ sec. per pixel, a maximum point gamma of a color image [which is denoted as simply as p–γ(max)] obtained after being subjected to color processing is not less than 3.6 and not more than 5.0 in the respective color image forming layers, i.e., $3.6 \leqq p\text{–}\gamma(\max) \leqq 5.0$. In cases where the p–γ(max) value of each of the color image forming layers is less than 3.6, the level of blurring occurring at character fringes easily varies when exposed in various digital exposure apparatuses differing in light source or exposure system or when varied in interval time between exposure and development. On the other hand, in cases of being more than 5.0, scanning exposure streaks readily occur in a solid image.

In this regard, it is preferred that, of p–γ(max) values of the color image forming layers, the difference between the maximum of the p–γ(max) values and the minimum thereof is not less than 0.0 and not more than 0.6, i.e., $$0.0 \leqq \Delta[p\text{–}(\max)] = [p\text{–}\gamma(\max)]_{max}[\text{–}p\text{–}\gamma(\max)]_{min} \leqq 0.6.$$

In preferred embodiments of the invention, when having been subjected to exposure to light so that the exposure time is $10^{-10}$ to $10^{-3}$ sec. per pixel, each of the color image forming layers, after having been subjected to color processing meets the following requirement:

$$0.16 \leqq VE/p\text{–}\gamma(\max) \leqq 0.21.$$

In this regard, it is preferred that, of VE/p–γ(max) values of the color image forming layers, the difference between the maximum of the VE/p–γ(max) values and the minimum thereof is not less than 0.00 and not more than 0.03, i.e., $$0.00 \leqq \Delta[VE/p\text{–}\gamma(\max)] = [VE/p\text{–}\gamma(\max)]_{max} - [VE/p\text{–}\gamma(\max)]_{min} \leqq 0.03.$$

In one preferred embodiment of the invention, the color image forming layers of the photographic material relating to the invention each meet the following requirement:

$$\Delta \text{Log } E \leqq 0.1$$

wherein ΔLog E is the difference between a logarithmic exposure giving the maximum point gamma value (γmd) when exposed so that the exposure time is $10^{-6}$ sec per pixel (which is also denoted simply as Log Ed) and then processed, and a logarithmic exposure giving the maximum point gamma value (γma) when exposed so that the exposure time is 0.5 sec per pixel (which is also denoted simply as Log Ea) and then processed, i.e., $\Delta \text{Log } E = |\text{Log } Ed - \text{Log } Ea|$.

The difference ΔLog E being not more than 0.1 means that when each of the color image forming layers of the photographic material is exposed for $10^{-6}$ sec. or 0.5 sec. and then process, and obtained characteristic curves are allowed to be overlapped at the point of a density of 0.8, the difference between positions corresponding exposures giving the maximum point gamma on both characteristic curves (ΔLog E) is not more than 0.1.

In the photographic material relating to this invention, at least one of the yellow image forming layer, magenta image forming layer and cyan image forming layer contains a compound represented by the following formula (1):

Formula (1)

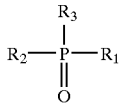

wherein $R_1$, $R_2$ and $R_3$ are each a substituent group, which may be the same or different.

The foregoing compounds represented by formula (1) are a compound capable of functioning as a high boiling solvent for couplers, which are usually in the form of liquid at room temperature, exhibiting a boiling point of 150° C. or higher. In formula (1), $R_1$, $R_2$ and $R_3$ are each a substituent group, and preferably an alkyl group or an aryl group, which preferably have a Log P value of 6.0 or more and a specific dielectric constant of 6.0 or more. The Log P is a logarithm of a partition coefficient in n-octanol/water, P and $$P = (\text{solute concentration in n-octanol phase})/(\text{solute concentration in water phase}).$$

The Log P value has been employed as a measure of hydrophobicity, for example, described in Chemical Review 555, 71 (6) (1971); Solubility Behavior of Organic Compound (Technique of Chemistry, vol. 21, John Wiley, 1990); (1989); Substituent Constants For Chemistry and Biology (John Wily &

Examples of specific compounds represented by formula (1) are shown below.

1-1

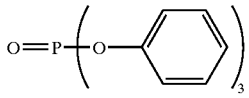

1-2

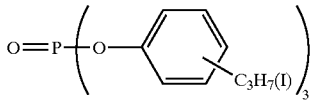

1-3

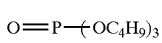

1-4

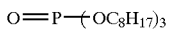

1-5

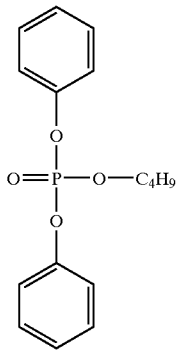

1-6

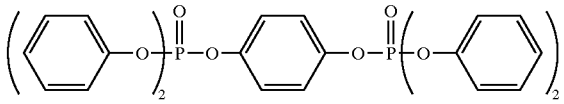

-continued 1-7

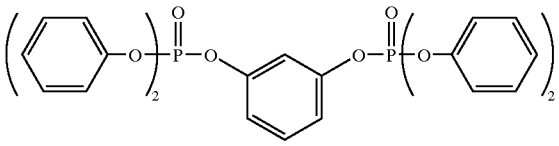

1-8

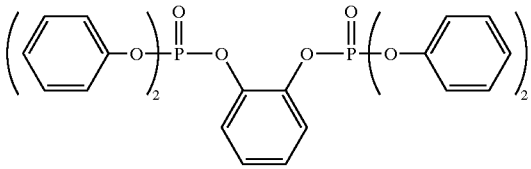

1-9

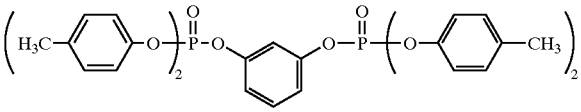

1-10

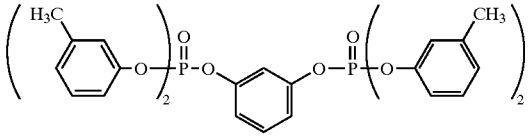

Silver halide color photographic materials relating to this invention are preferably subjected to color development for a period of not more than 25 sec., and more preferably not more than 20 sec. Examples of a means for shortening a color development time include performing color development with a color developer solution having a pH of at least 10.30 (preferably at least 10.50), or at a temperature of at least 38° C. (at least 40° C.).

The invention further concerns the following embodiments;

a silver halide color photographic material comprising a support having thereon a yellow image forming layer, a magenta image forming layer and a cyan image forming layer, each of the image forming layers comprising light sensitive silver halide, wherein when the photographic material having been exposed to light so that the exposure time per pixel is $10^{-10}$ to $10^{-3}$ sec. per pixel, at least one of the yellow, magenta and cyan color images obtained after having been processed meets the following requirements (1) and (2):

$$1.8 \leqq p\text{-}\gamma(\max)/\text{maximum density} \leqq 5.0 \quad (1)$$

$$0 \leqq [p\text{-}(0.5)/\text{maximum density}]/[p\text{-}(\max)/\text{maximum density}] \leqq 0.5 \quad (2)$$

wherein term, p-(max) represents a maximum point gamma and p-(0.5) represents a point gamma at a density of 0.5;

the photographic material described above, wherein the magenta and cyan images each meet the foregoing requirements (1) and (2);

a silver halide color photographic material comprising a support having thereon a yellow image forming layer, a magenta image forming layer and a cyan image forming layer, each of the image forming layers comprising light sensitive silver halide, wherein when the photographic material having been exposed to light so that the exposure time per pixel is $10^{-10}$ to $10^{-3}$ sec. per pixel, at least one of the yellow, magenta and cyan color images obtained after having been processed meets the foregoing requirement (1) and the following requirements (3):

$$0 \leqq [p\text{-}(0.5)/\text{maximum density}]/[p\text{-}(\max)/\text{maximum density}] \leqq 0.3 \quad (2);$$

a silver halide color photographic material comprising a support having thereon a yellow image forming layer, a magenta image forming layer and a cyan image forming layer, each of the image forming layers comprising light sensitive silver halide, wherein when the photographic material having been exposed to light so that the exposure time per pixel is $10^{-10}$ to $10^{-3}$ sec. per pixel, at least one of the yellow, magenta and cyan color images obtained after having been processed meets the foregoing requirement (2) and the following requirements (4):

$$0.2 \text{ Log } E < \text{main tone range} < 0.45 \text{ Log } E \quad (4)$$

wherein the main tone range is an exposure region (expressed in logarithmic exposure, Log E) between the exposure giving a density of 0.3 and the exposure giving 80% of the maximum density, in which expression, 80% of the maximum density means a density corresponding to 80% of the maximum density on the characteristic curve for the respective color images (e.g., 2.0 when the maximum density is 2.5);

The photographic material described above, wherein the magenta and cyan images each meet the foregoing requirements (2) and (4);

the photographic material described above, wherein at least one of the color images meets the foregoing requirements (2) and (3); and the photographic material described above, wherein the support contains a fluorescence compound.

In this invention are obtained prints exhibiting enhanced character reproduction and exhibiting reduced scanning unevenness in scenic images even when exposed in various digital exposure apparatuses having different exposure light sources and exposure systems, and are stably obtained prints exhibiting little variation in density even when the interval between exposure and development is varied. However, the mechanism thereof is not clearly understood but it is supposed to be due to following factors. Thus, a silver halide color photographic material is exposed to form a latent image in the vicinity of a sensitivity speck of light sensitive silver halide, which is further developed to obtain print images. However, sensitivity specks formed mainly by chemical sensitization and latent images formed by exposure to light respectively are not uniform, and the sensitivity specks and the latent images respectively exist in various states, and having a distribution. It is supposed that such a distribution is basically reflected in a characteristic curve and it is therefore supposed that most photographic materials differing in characteristic curve form are different in distribution of sensitivity specks or latent images. It is assumed that when exposed to light at a high intensity for a short period, sensitivity specks which are easily affected by exposure intensity or time exist. Accordingly, it is supposed that in cases where respective parameters are designed so as to fall within the range of this invention, the proportion of sensitivity specks which are easily affected becomes less, leading to enhanced stability of print reproduction even when exposed to different light sources or in different exposure systems. Furthermore, it is assumed that when exposed to light at a high intensity for a short period, latent images which are easily variable by aging after exposure exist, accordingly, it is supposed that in cases where respective parameters are designed so as to fall within the range of this invention, the proportion of latent images which are easily variable becomes less, leading to enhanced stability of print reproduction even when varying in interval between exposure and development.

Means for meeting the requirements of this invention are not specifically limited and, for example, optimally controlling characteristics of light sensitive silver halide contained in photographic material and controlling light sensitive silver halide, couplers or inhibitors with respect to the kind or amount thereof are employed alone or in combination.

To form photographic images using the silver halide color photographic material relating to this invention, it is preferred to use an exposure system in which exposure is performed for a period of $10^{-10}$ to $10^{-3}$ sec. per pixel, based on digital image data. A scanning exposure system using a light beam is specifically preferred in terms of high quality prints being obtained, while maintaining high productivity.

In general, scanning exposure with light beams is conducted by a combination of linear exposures with a light beam (i.e., raster exposure or main scanning) and shifting photographic material in the direction perpendicular to the linear exposure (i.e., sub-scanning). There may be employed, for example, a system, in which a photographic material is fixed onto the exterior or interior surface of a cylindrical drum (drum system), and the main scanning is performed by rotating the drum under an irradiating light beam and the sub-scanning is concurrently performed by shifting the light source perpendicular to the rotating direction of the drum; and a system, in which a light beam is irradiated onto a polygon mirror and the reflected beam is allowed to scan horizontally to the rotating direction of the polygonal mirror (main scanning) and the photographic material is concurrently allowed to move vertically to the rotating direction of the polygon mirror to perform the sub-scanning (a polygon system). In the drum system, the main scanning speed can be controlled by adjusting the diameter or the rotating speed of the drum and the sub-scanning speed can be controlled by adjusting the shift speed of the light source. In the polygon system, the main scanning speed can be controlled by adjusting the size, number of faces or rotating speed of the polygon mirror and the sub-scanning can be controlled by adjusting the transport speed of the photographic material.

The light beam overlap between rasters can optimally be controlled by adjusting timing of the main scanning speed and the sub-scanning speed. In cases when an exposure head having arrayed light sources is employed, overlap between rasters can be controlled by optimally adjusting spacing between the light sources.

As light sources usable in the invention are employed those known in the art, including a light emission diode (LED), a gas laser, a semiconductor laser (LD), a combination of an LD or solid laser using LD as an exciting light source, and secondary harmonic generator element (so-called SHG element), organic or inorganic EL elements, and commonly known vacuum fluorescent display tube. There are also preferably employed a combination of a halogen lamp and a PLZT element, DMD element or shutter element such as liquid crystal and a combination of a color filter.

Any kind of silver halide is usable in photographic materials according to the invention. Silver bromochloride, silver iodochlorobromide, silver iodochloride, silver chloride, silver bromide and silver iodobromide can be used alone of in combination. Specifically, silver bromochloride or silver iodobromochloride containing at least 95 mol % chloride lead to markedly enhanced effects of this invention. Silver halide emulsions preferably containing at 97 mol %, and more preferably 98 to 99.9 mol % chloride are preferred in terms of rapid processibility and process stability.

Silver halide grains containing high bromide phase within the grain are preferably used in photographic materials used in the invention. In this case, the high bromide phase may be in the form of a layer, such as in core/shell type grains or in the form of a partial region different in composition, so-called epitaxial junction. The composition may vary continuously or discontinuously. The high bromide phase is localized preferably in the corner of silver halide grains.

In order to reduce contrast-decreasing upon scanning exposure at a high intensity for a short period in the silver halide emulsion relating to the present invention, heavy metal ions are advantageously incorporated. Heavy metal ions which can be employed for this purpose can include an ion of each of the Groups 8 to 10 metals such as iron, iridium, platinum, palladium, nickel, rhodium, osmium, ruthenium, cobalt, etc. and the Group 12 metals such as cadmium, zinc, mercury, etc. and lead, rhenium, molybdenum, tungsten, gallium, chromium. Of them, any ion of iron, iridium, platinum, ruthenium, gallium, osmium is preferable. Any of these ions can be added to the silver halide emulsion in the form of a salt or complex.

When the aforementioned heavy metal ion forms a complex, preferred examples of the ligand include a cyanide ion, a thiocyanate ion, an isothiocyanate ion, a cyanate ion, a chloride ion, a bromide ion, an iodide ion, carbonyl, ammonia, etc. Of those, the cyanide ion, the thiocyanate ion, the isocyanate ion, the chloride ion and the bromide ion, etc.

To allow a heavy metal ion to be occluded within the silver halide emulsion grains according to the present invention, the addition of the corresponding heavy metal compound may be optionally conducted at any point of each process before forming silver halide grains, during forming silver halide grains and during physical ripening after forming silver halide grains. In order to prepare the silver halide emulsion which meets the aforementioned conditions, the heavy metal compound is dissolved together with halide salts and the resulting solution can be continuously added during whole or part of a grain forming process.

The addition amount of the heavy metal ion in the silver halide emulsion is preferably not less than $1\times10^{-9}$ mole and not more than $1\times10^{-2}$ mole per 1 mole of silver halide, and more preferably not less than $1\times10^{-8}$ mole and not more than $5\times10^{-5}$ mole per 1 mole of silver halide.

Any shape of the silver halide grains according to the present invention can be optionally employed. One of preferred examples is a cube having (100) faces as crystal surfaces. Furthermore, grains having the shape of octahedron, tetradecahedron, dodecahedron, etc. are prepared according to methods described in U.S. Pat. Nos. 4,183,756, 4,225,666, Japanese Patent Publication Open to Public Inspection No. 55-26589, Japanese Patent Publication No. 55-42737 and in Journal Photographic Science, Vol. 21, p. 39 (1973), etc., and are employed. Furthermore, grains having twinning faces may be employed.

As the silver halide grains according to the present invention, grains having the sane shape are preferably employed. In addition, two or more of monodisperse silver halide emulsions are preferably added to the same layer.

Silver halide grains used in the invention are not limited with respect to grain size but the grain size is preferably 0.1 to 1.2 $\mu$m, and more preferably 0.2 to 1.0 $\mu$m in terms of rapid processibility, sensitivity and other photographic performance. The grain size can be determined using grain projected areas or diameter approximation values. In the case of silver halide grains having substantially uniform shape, the grain size distribution can be presented in terms of diameter or projection area. With regard to the grain size distribution is preferred monodisperse silver halide grains having a coefficient of variation of 0.22 or less, and more preferably 0.15 or less.

It is specifically preferred that at least two kinds of monodisperse grain emulsions having a coefficient of variation of 0.05 to 0.15 be included in the same layer. The coefficient of variation is referred to as a coefficient representing a width of the grain size distribution and defined according to the following equation:

$$\text{Coefficient of variation}=S/R$$

where S is a standard deviation of grain size distribution and R is a mean grain size. Herein, the grain size is a diameter in the case of spherical grain, and in the case of being cubic, or shape other than spherical form, the grain size is a diameter of a circle having an area equivalent to the grain projected area.

Apparatuses for preparing the silver halide emulsion and the preparation methods known in the art in the photographic industry can be employed. The silver halide emulsion according to the present invention can be prepared employing any of an acid method, a neutral method or an ammonia method. The grains can be grown at one time and can be grown after preparing seed grains. The method for preparing seed grains and the method for growing grains may be the same or different.

Furthermore, as methods for reacting soluble silver salts with soluble halide salts, any of a normal mixing method, a reverse mixing method, a double jet method or combination thereby can be employed. However, the double jet method is preferably employed. Further, a pAg controlled double jet method can be employed which is described as one of the simultaneous mixing methods in Japanese Patent Publication Open to Public Inspection No. 54-48521.

Furthermore, apparatuses can be employed described in Japanese Patent Publication Open to Public Inspection Nos. 57-92523, 57-92524, etc. wherein an aqueous water-soluble silver salt solution and an aqueous halide salt solution are supplied from addition devices arranged in a reaction mother solution, described in German Patent Open to Public Inspection No. 2,921,164, etc. wherein an aqueous water-soluble silver salt solution and an aqueous halide salt solution are added while changing continuously the concentration, described in Japanese Patent Publication No. 56-501776 wherein a reaction mother solution is taken out of a reactor and by increasing the concentration using an ultrafiltration method, grains are grown while holding distances between silver halide grains constant. Furthermore, silver halide-dissolving solvents such as thioether, etc. can be employed, if desired. In addition, compounds having a mercapto group, nitrogen containing heterocyclic compounds or compounds such as spectral sensitizers can be added during the formation of sliver halide grains or after the grain formation.

Silver halide emulsions used in photographic materials of this invention can be sensitized by the combination of sensitization with a gold compound and sensitization with a chalcogen sensitizer. The chalcogen sensitizer include a sulfur sensitizer, selenium sensitizer and tellurium sensitizer and of these is preferred the sulfur sensitizer. Examples of the sulfur sensitizer include a thiosulfate, allylthiocarbamidothiourea, allylisothiocyanate, cystine, p-toluenethiosulfonate, rhodanine, and inorganic sulfurs. It is preferred to vary amounts of a sulfur sensitizer, depending on the kind of silver halide emulsion or expected effects. The sulfur sensitizer is added preferably in an amount of $5\times10^{-10}$ to $5\times10^{-5}$ mol, and more preferably $5\times10^{-8}$ to $3\times10^{-5}$ mol per mol of silver halide. Gold sensitizers include, for example, chloroauric acid and gold sulfide, and may also be added in the form of various gold complex. In this case, ligand compounds used therein include, for example, dimethylrhodanine, thiocyanic acid, mercaptotetrazole, and mercaptotriazole. The amount of a gold compound used therein, depending on the kind of a silver halide emulsion, the kind ot the compound and ripening conditions, is preferably $1\times10^{-8}$ to $1\times10^{-8}$ mol, and more preferably $1\times10^{-3}$ to $1\times10^{-5}$ mol per mol of silver halide.

An antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column, such as compounds represented by formula (II) described in page 7. Specifically, examples of preferred compounds include compounds (IIa-1) through (IIa-8) and (IIb-1) through (IIb-7) described on page 7 in the foregoing publication, and compounds such as 1-(3-methoxyphenyl)-5-mercaptotetrazole and 1-(4-ethoxyphenyl)-5-mercaptptetrazole. These compounds are added in the step of preparing a silver halide emulsion, the chemical sensitization step or the course of from completion of chemical sensitization to preparation of a coating solution. In cases when chemical sensitization is performed in the presence of these compounds, the amount thereof is preferably $1\times10^{-6}$ to $5\times10^{-4}$ mol per mol of silver halide. In cases when added at the time of completion of chemical sensitization, the amount thereof is preferably $1\times10^{-6}$ to $1\times10^{-2}$ mol, and more preferably $1\times10^{-5}$ to $5\times10^{-3}$ mol per mol of silver halide. In cases when added in the stage of preparation of a coating solution, the amount thereof is preferably $1\times10^{-6}$ to $1\times10^{-1}$ mol, and more preferably $1\times10^{-5}$ to $1\times10^{31\ 2}$ mol per mol of silver halide. In cases when added to a layer other than the silver halide emulsion layer, the content in the layer is preferably $1\times10^{-9}$ to $1\times10^{-3}$ mol per $m^2$.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 308, AI-1 to 11, and JP-A 6-3770; infrared absorbing dyes described in JP-A 1-280750 at page 2, left lower column, formula (I), (II) and (III).

To enhance sharpness at the exposure of a ultra-high intensity and ultra-short time, such as laser light exposure, and at the exposure of a high intensity and short time, such as exposure using LED the amount and kind of a dye are optimally selected; a preferred embodiment is a silver halide color photographic material having a spectral sensitivity maximum at the wavelength of 630 to 730 nm and a reflectance at 670 nm of 8.3 to 10% of incident light, a more preferred embodiment is a silver halide color photographic material having a spectral sensitivity maximum at the wavelength of 520 to 570 nm and a reflectance at 550 nm of 38 to 50% of incident light, and still more preferred embodiment is a silver halide color photographic material having a spectral sensitivity maximum at the wavelength of 450 to 500 nm and a reflectance at 460 nm of 50 to 63% of incident light.

Fluorescent brightening agents are also incorporated into the photographic material to improve whiteness. Examples of preferred compounds include those represented by formula II described in JP-A-2-232652.

The photographic material used in the invention comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof.

In the silver halide emulsions used in the invention can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infra-red ray with a semiconductor laser, infrared-sensitive sensitizing dyes are employed. Compounds IRS-1 to 11 described in JP-A 4-285950 at pages 6–8 are preferably employed as a blue-sensitive sensitizing dye. Supersensitizers SS-1 to SS-9 described in JP-A 4-285950 at pages 8–9 and compounds S-1 to S-17 described in JP-A 5-66515 at pages 5-17 are preferably included, in combination with these blue-sensitive, green-sensitive and red-sensitive sensitizing dyes.

The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of a solid particle dispersion.

As couplers employed in the light-sensitive material according to the present invention, can be employed any compounds which can form a coupling product (e.g., a dye) having a spectral absorption maximum at the wavelengths of 340 nm or longer upon coupling with an oxidized color developing agent. Particularly, representative compounds include a yellow dye forming coupler having a spectral absorption maximum at the wavelengths in the region of 350 to 500 nm, magenta dye forming coupler having a spectral absorption maximum at the wavelengths in the region of 500 to 600 nm and a cyan dye forming coupler having a maximum spectral absorption at the wavelengths in the region of 600 to 750 nm.

Examples of cyan couplers preferably used in the photographic material include couplers described in JP-A 4-114154, at page 5, left lower column and represented by formulas (C-I) and (C-II); specific compounds thereof include CC-1 through CC-9 described in right lower column on page 5 to left lower column on page 6 in the foregoing specification.

Examples of magenta couplers preferably usable in the photographic material employed in the invention include couplers represented by formula (M-I) of (M-II) described in JP-A 4-114154 at page 4, right upper column. Examples of specific compounds thereof include MC-1 through MC-11 described in left lower column on page 4 to right upper column on page 5 in the foregoing specification Of these couplers are preferred those represented by formula (M-I). A coupler which has a tertiary alkyl group as RM of formula (M-I), is more preferable in terms of being superior in light fastness. Specifically, couplers MC-8 through MC-11 described in upper column on page 5 in the specification, which exhibit superior color reproduction within the range of blue to violet, and further to red and are also superior in representation in details, are preferred.

Examples of preferred yellow couplers include those which are represented by general formula (Y-I) described in JP-A 4-114154 at page 3, right upper column. Exemplary compounds described therein (page 3, left lower column) are YC-1 to YC-9. Of these yellow couplers are preferred couplers in which RY1 in formula (Y-I) is an alkoxy group are specifically preferred or couplers represented by formula [I] described in JP-A 6-67388. Specifically preferred examples thereof include YC-8 and YC-9 described in JP-A 4-114154 at page 4, left lower column and Nos. (1) to (47) described in JP-A 6-67388 at pages 13–14. Still more preferred examples include compounds represented by formula [Y-1] described in JP-A 4-81847 at page 1 and pages 11–17.

When an oil-in-water type-emulsifying dispersion method is employed for adding couplers and other organic compounds used for the photographic material of the present invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant. As a dispersing means, a stirrer, a homogenizer, a colloidal mill, a flow jet mixer and a supersonic dispersing machine may be used. Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5 to 7.0 are also preferred. These high boiling solvents may be used in combination.

Instead of or in combination with the high boiling solvent is employed a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

The dispersion is conventionally added to a coating solution containing a silver halide emulsion. The elapsed time from dispersion until addition to the coating solution and the time from addition to the coating solution until coating are preferably short. They are respectively preferably within 10 hours, more preferably within 3 hours and still more preferably within 20 minutes.

As a surfactant used for adjusting surface tension when dispersing or coating photographic additives, the preferable compounds are those containing a hydrophobic group having 8 through 30 carbon atoms and a sulfonic acid group or its salts in a molecule. Exemplary examples thereof include A-1 through A-11 described in JP-A No. 64-26854. In addition, surfactants, in which a fluorine atom is substituted to an alkyl group, are also preferably used.

To each of the above-mentioned couplers, to prevent color fading of the formed dye image due to light, heat and humidity, an anti-fading agent may be added singly or in combination. The preferable compounds or a magenta dye are phenyl ether type compounds represented by Formulas I and II in JP-A No. 2-66541, phenol type compounds represented by Formula IIIB described in JP-A No. 3-174150, amine type compounds represented by Formula A described in JP-A No. 64-90445 and metallic complexes represented by Formulas XII, XIII, XIV and XV described in JP-A No. 62-182741. The preferable compounds to form a yellow dye and a cyan dye are compounds represented by Formula I' described in JP-A No. 1-196049 and compounds represented by Formula II described in JP-A No. 5-11417.

A compound (d-11) described in JP-A 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

It is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A No. 4-133056, and compounds II-1 through II-14 described in the above-mentioned specification pages. 13 to 14 and compound 1 described on page 17.

In the photographic material according to the present invention, it is preferable that static fogging is prevented and light-durability of the dye image is improved by adding a UV absorber. The preferable UV absorbent is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper of these supports a paper support coated, on both sides, with water-proof resin layer. As the water-proof resin are preferably employed polyethylene, ethylene terephthalate and a copolymer thereof.

Inorganic and/or organic white pigments are employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, and clay. Preferred examples of white pigments include barium sulfate and titanium oxide. The amount of the white pigment to be added to the water-proof resin layer on the support surface is preferably not less than 13% by weight, and more preferably not less than 15% by weight to improve sharpness.

The dispersion degree of a white pigment in the water-proof resin layer of paper support can be measured in accordance with the procedure described in JP-a 2-28640. In this case, the dispersion degree, which is represented by a coefficient of variation is preferably not more than 0.20, and more preferably not more than 0.15.

Supports having a center face roughness (Sra) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention.

In coating of the photographic material, a thickening agent may be employed to enhance coatability of a coating solution. As a coating method are useful extrusion coating and curtain coating, in which two or more layers are simultaneously coated.

It is preferable to apply the present invention to a photographic material forming images for direct appreciation, including color paper, color reversal paper, positive image forming photographic material, photographic material for display use and photographic material for use in color proofing.

Employed as an aromatic primary amine developing agent used in the invention are compounds known in the art. Examples of the aromatic primary amine developing agents include N,N-diethyl-p-phenylendiamine2-amino-5-diethylaminotoluene, 2-amino-S-(N-ethyl-N-laurylamino) toluene, 4-(N-ethyl-N-(β-hydroxyethyl)amino)aniline, 2-methyl-4-(N-ethyl-N-(β-hydroxyethyl)amino)aniline, 4-amino-3-methyl-N-ethyl-N-(β-methanesulfoneamido) ethyl)aniline, N-(2-amino-5-diethylaminophenylethyl) methanesulfonamide, N,N-dimethyl-p-phenylenediamine, 4-amino-3-methyl-N-ethyl-N-metoxyethylaniline, 4-amino-3-methyl-N-ethyl-N-(β-ethoxyethyl)aniline, 4-amino-3-methyl-N-ethyl-N-(γ-hydroxypropyl)aniline, 4-amino-3-methyl-N-ethyl-N-(4-hydroxybutyl)aniline, 4-amino-3-methyl-N-ethyl-N-(β-hydroxypropyl)aniline, 4-amino-3-methyl-N-ethyl-N-(2-hydroxy(1-methyl)ethyl)aniline, 4-amino-3-ethyl-N-methyl-N-(γ-hydroxypropyl)aniline; and various aromatic primary amine developing agents described in JP-A 3-345142, 4-11255, 4-45440, 4-226452, and 4-371948. Besides the aromatic primary amine developing agents, sulfophenylhydrazine or carbonylhydrazine type developing agents are also preferably employed, as described in European Patent 565,165, 572,054 and 593,110, JP-A 8-202002, 8-227131 and 8-234390. There are also preferred sulfonamidophenol type color developing agents described in JP-A 11-149146.

The color developing solution containing a color developing agent described above can be used at an appropriate pH, and the pH is preferably 9.5 to 13.0, and more preferably 9.8 to 12.0 in terms of rapid access. The color developing temperature relating to the invention is preferably 35 to 70° C. Higher temperature promote development, but the temperature range of 37 to 60° C. is specifically preferred in terms of process stability. The color developing time is preferably 45 sec. or less and more preferably 30 sec. or less.

In addition to the developing agents described above, the developing solution is added with commonly known developer component compounds, including an alkaline agent having pH-buffering action, a development inhibiting agent such as chloride ion or benzotriazole, a preservative, and a chelating agent.

Photographic materials relating to this invention, after being developed, are further subjected to bleaching and fixing. Iron complex salts of polycarboxylic acids are usually employed as a preferred bleaching agent. Specifically preferred compounds include bleaching agents described in JP-A 5-281684.

The bleaching agent is used preferably in an amount of 0.05 to 50 g, and more preferably 0.1 to 20 g per liter of solution. The temperature of a bleaching solution or a blexh0fixing solution is 20 to 50° C., and more preferably 25 to 45° C. in view of bleaching time and bleach fogging. The pH of a bleaching solution is preferably not more than 6.0, and more preferably 1.0 to 5.5; and the pH of a bleach-fixing solution is preferably 5.0 to 9.0, and more preferably 6.0 to 8.5. This pH of a bleaching solution or bleach0fixing solution refers to a pH in a processing tank used for processing silver halide color photographic material, and is definitely distinguished from a pH of a so-called replenishing solution.

To the bleaching solution or bleach-fixing solution may be added a halide compound, such as ammonium bromide, potassium bromide and sodium bromide, and various kinds of fluorescent brightening agents, defoaming agents and surfactants, other than the foregoing compounds.

The replenishing rate of a bleaching or bleach-fixing solution is preferably 500 ml or less, and more preferably 40 to 350 ml per $m^2$ of photographic material. In order to strengthen activity of a bleaching or bleach-fixing solution, there may conducted air-blowing or oxygen-blowing into a processing tank or replenisher storage tank. Alternatively, oxidizing agents such as hydrogen peroxide, bromates, persulfates may optionally added.

Preferred fixing agents used in the fixing or bleach-fixing solution include, for example, thiocyanates and thiosulfates. In addition to the fixing agent, the fixing or bleach-fixing solution may contain a pH buffering agents alone or in combination. It is desirable to contain an optimal amount of a re-halogenating agent, such as alkali halides and ammonium halides, e.g., potassium bromide, sodium bromide and ammonium bromide. Compounds such as alkylamines and polyethylene oxides, which are usually added to the fixing or bleach-fixing solution may optionally be incorporated.

In this invention, silver recovery from the bleach-fixing solution may be conducted in accordance with commonly known methods. The processing time in a fixing solution or bleach-fixing solution is optional, and preferably not longer than 3 min. 30 sec., more preferably 10 sec. to 2 min. 20 sec., and still more preferably 20 sec. to 1 min. 20 sec. The processing time in the bleach-fixing solution is preferably not longer than 4 min., and more preferably 10 sec. to 2 min. 20 sec.

The ratio of ammonium ion to the whole cation in the bleaching or bleach-fixing solution is preferably not more than 50 mol %, more preferably not more than 30 mol %, and still more preferably not more than 10 mol %.

It is preferred to provide forced stirring to the bleaching or bleach-fixing solution in terms of enhanced processing speed. The forced stirring means providing a stirring means to forcibly conduct stirring. AS a forced stirring means are preferably employed means described in JP-A 64-222259 and 1-206343.

The cross-over time from a color developing tank to a bleaching tank or a bleach-fixing tank is preferably 10 sec, or less, and more preferably 7 sec. or less in terms of reduced bleach-fogging. It is preferred that the bleaching or bleach-fixing solution is substantially free from acetic acid.

Subsequent to the bleach-fixing or fixing, washing is conventionally carried out. Stabilizing may be conducted in place of washing.

As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. A large amount of photographic materials are conventionally processed using an automatic processor. In this case, the less replenishing rate is preferred and an environmentally friendly embodiment of processing is replenishment being made in the form of a solid tablet, as described in KOKAI-GIHO (Disclosure of Techniques) 94-16935.

The silver halide photographic materials according to the invention are also applicable to a thermally developable photothermographic system. Herein, the thermal development is refers to performing development by heating exposed photographic materials at a temperature of 50 to 250° C., and preferably 60 to 150° C. Heating is conducted, for example, in such a manner that a photographic material is transported with heating, while being interposed between a heated drum and a drum belt, as described in JP-A 63-71850; by a direct heating system in which a photographic material is set between a heated and a supporting platform and heated with compressing, by a method of passing through far infrared heaters, as described in JP-A 4-240642; by a indirect heating system in which a photographic material is heated with irradiating a microwave; and by the combination of direct and indirect heating systems.

In the thermal development are employed a so-called single sheet system, in which a photographic material sheet alone is exposed and thermally developed to obtain final images, as described in JP-A 63-108337; and a so-called two sheets system, in which using a photographic material and a dye image receiving material, imaging dyes formed or released upon thermal development are transferred through diffusion from the photographic material to the dye image receiving material to obtain final images, as described in Example 1 of JP-A 6-95321 and Example 1 of JP-A 7-225461. There is also employed a system in which a photosensitive layer and a dye image receiving layer are provided on a support, imaging dyes formed or released upon thermal development are transferred through diffusion from the photosensitive layer to the dye image receiving layer and then the photosensitive layer is peeled off.

In the thermal development are also applicable a method in which development is conducted only by heating, without supplying a reaction-aid, as described in Example 1 of JP-A 2-120739; and a method, in which after externally supplying a small amount of a reaction-aid (e.g., water), thermal development is carried out, as described in JP-A 9-5968. In cases where no reaction-aid is externally supplied, it is preferred to allow a thermal solvent, which is solid at ordinary temperature and capable of being liquidized at a thermal development temperature, to be incorporated into a photographic material. Examples of the thermal solvent include compounds described in JP-A 1-227150 at page 4, left upper column to page 9, right upper column, and JP-A 4-289856 at column [0015] to [00181].

The use of a base-generating agent in thermal development is preferred to enhance a silver development rate or a diffusion rate of a imaging dye. Base generation can be performed by the use of a compound capable of generating a base upon thermal decomposition, as described in JP-A 59-157637 at page 3, lower right to page 6 and JP-A 59-180537 at page 4, upper left to page 7, lower left; or by the use of a water-insoluble basic metal compound in combination with a compound which is capable of forming a complex with a metal ion constituting the basic metal compound in the presence of a small amount of water, as described in JP-A 8-87097, European patent No. 210,660 and U.S. Pat. No. 4,740,445.

It is useful to incorporate an organic silver salt into the photographic material to promote silver development.

Preferred examples of such an organic silver salt include a silver salt of a long chain fatty acid or a hetelocyclic carboxylic acid described in JP-A 49-52626 and 53-36224, a silver salt of an imino group containing compound described in JP-A 52-137321 and 58-118638, and a silver salt of an acetylene compound described in JP-A 61-249044.

It is preferable to employ a dye mordant to minimize bleeding or fading of an image in photothermographic materials. Examples of preferred dye mordants include polymers containing a tertiary amine or quaternary ammonium salt, such as compounds described in JP-A 9-5968 at column [0057] to [0060].

In cases when the photographic material according to the invention is employed in thermal development, compound forming or releasing an imaging dye (i.e., dye providing material) include couplers releasing a diffusible dye described in JP-A 61-61157, 61-61158, 62-44738, 62-129850, 62-129851, 62-169158, 3-73949; a leuco dye described in JP-A 61-88254; an azo dye described in U.S. Pat. No. 4,235,957; compounds described in JP-A 59-60434, 59-65839, 59-71046, 59-87450, 59-165055 and a compound capable of forming an imaging dye in response to silver development described in JP-A 59-55430, 59-165054, 59-154445, 59-116655, 59-124327, 59-15244064-13546 and 6-51474.

There is employed a thermal development system described in JP-A 2-293753 and 2-308162, in which a photographic material which employs a micro-capsule containing a polymeric compound described in JP-A 2-293753 and 2-308162 and the foregoing dye providing material, is subjected to thermal development to undergo imagewise or counter-imagewise polymerization reaction to harden the microcapsule, thereby causing variation in a diffusion rate of an imaging dye or physical strength of a binder to form images.

In one embodiment of the invention, a developing agent or its precursor may be incorporated into a photographic material. Developing agents to be incorporated into the photographic material are required to stable during storage of the photographic material, without causing unwanted reduction of silver salts. Examples of developing agents satisfying such a requirement include p-phenylenediamine type developing agents described in 62-288835, sufonamidophenol type developing agents described in JP-A 9-15806, hydrazine type developing agents described in 5-241282, 8-234388, 8-286340, 9-152700, 9-152701, 9-152702, 9-152703 and 9-152704, and hydrazone type developing agents described in JP-A 7-202002 and 8-234390.

The photographic material containing a developing agent may be developed through an activator treatment. The activator treatment refers to processing with a processing solution (activator solution) containing no developing agent. In such a case, compounds necessary to perform color development are occluded in advance in the photographic material. The activator solution, which is characterized in containing no color developing agent used in conventional color developing solution, may contain other constituents. such as alkali and an auxiliary developing agent. The activator treatment is exemplarily described in European Patent 545,491A1 and 565,165A1.

EXAMPLES

The present invention will be further explained based on examples, but embodiments of the invention are not limited to these.

Example 1

Preparation of Silver Halide Emulsion

Preparation of Blue-sensitive Silver Halide Emulsion

To 1 liter of aqueous 2% gelatin solution kept at 40° C. were simultaneously added the following solutions (Solutions A1 and B1) for a period of 30 min., while being maintained at a pAg of 7.3 and pH of 3.0, and further thereto were added Solutions C1 and D1 for a period of 150 min., while being maintained at a pAg of 8.0 and pH of 5.5. Further thereto were added Solutions E1 and F1 for a period of 30 min., while being maintained at a pAg of 8.0 and pH of 5.5. The pAg was controlled by the method described in JP-A 59-45437, and the pH was adjusted using aqueous sulfuric acid or sodium hydroxide solution.

| | |
|---|---|
| Solution A1 | |
| Sodium chloride | 3.42 g |
| Potassium bromide | 0.03 g |
| Water to make | 200 ml |
| Solution B1 | |
| Silver nitrate | 10 g |
| Water to make | 200 ml |
| Solution C1 | |
| Sodium chloride | 71.9 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 0.7 g |
| Water to make | 420 ml |
| Solution D1 | |
| Silver nitrate | 210 g |
| Water to make | 420 ml |
| Solution E1 | |
| Sodium chloride | 30.8 g |
| Potassium bromide | 0.3 g |
| Water to make | 180 ml |

-continued

| Solution F1 | |
|---|---|
| Silver nitrate | 90 g |
| Water to make | 180 ml |

After completing the addition, the resulting emulsion was desalted using a 5% aqueous solution of Demol N (produced by Kao-Atlas) and aqueous 20% magnesium sulfate solution, and redispersed in a gelatin aqueous solution to obtain a monodisperse cubic grain emulsion (EMP-1A) having an average grain size of 0.64 $\mu$m, a coefficient of variation of grain size of 0.07 and a chloride content of 99.5 mol %.

A mono-disperse cubic grain emulsion (EMP-1B) having an average grain size of 0.50 $\mu$m, a coefficient of variation of grain size of 0.07 and a chloride content of 99.5 mol % was prepared similarly to the foregoing emulsion (EMP-1A), provided that the addition time of Solutions A1 and B1, the addition time of Solutions C1 and D1 and the addition time of Solution E1 and F1 were respectively varied.

The thus obtained emulsion, EMP-1A was chemically sensitized at 60° C. using the following compounds. Similarly, emulsion EMP-1B was chemically sensitized. The thus chemically sensitized emulsions EMP-1A and EMP-1B were mixed in a ratio of 1:1 to obtain blue-sensitive silver halide emulsion (Em-B1).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

STAB-1: 1-(3-Acetoamidophenyl)-5-mercaptotetrazole
STAB-2: 1-Phenyl-5-mercaptotetrazole
STAB-3: 1-(4-Ethoxyphenyl)-5-mercaptotetrazole Preparation of Green-sensitive Silver Halide Emulsion Monodisperse cubic grain emulsions, EMP-2A having an average grain size of 0.50 $\mu$m, a coefficient of variation of grain size of 0.08 and a chloride content of 99.5 mol %, and EMP-2B having an average grain size of 0.45 $\mu$m and a chloride content of 99.5 molt were prepared in the same manner as in preparation of EMP-1A and EMP-1B, respectively, provided that the addition time of Solutions A1 and B1, the addition time of Solutions C1 and D1 and the addition time of Solution E1 and F1 were respectively varied.

The thus obtained emulsion, EMP-2A was chemically sensitized at 60° C. using the following compounds. Similarly, emulsion EMP-2B was chemically sensitized. The thus chemically sensitized emulsions EMP-2A and EMP-2B were mixed in a ratio of 1:1 to obtain blue-sensitive silver halide emulsion (Em-G1).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye GS-1 | $4 \times 10^{-4}$ mol/mol AgX |

Preparation of Red-sensitive Silver Halide Emulsion

Monodisperse cubic grain emulsions, EMP-3A having an average grain size of 0.40 $\mu$m, a coefficient of variation of grain size of 0.08 and a chloride content of 99.5 mol %, and EMP-3B having an average grain size of 0.42 $\mu$m and a chloride content of 99.5 mol % were prepared in the same manner as in preparation of EMP-1A and EMP-1B, respectively, provided that the addition time of Solutions A1 and B1, the addition time of Solutions C1 and D1 and the addition time of Solution E1 and F1 were respectively varied.

The thus obtained emulsion, EMP-3A was chemically sensitized at 60° C. using the following compounds. Similarly, emulsion EMP-2B was chemically sensitized. The thus chemically sensitized emulsions EMP-3A and EMP-3B were mixed in a ratio of 1:1 to obtain blue-sensitive silver halide emulsion (Em-R1).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |
| SS-1 | $2.0 \times 10^{-3}$ mol/mol AgX |

BS-1

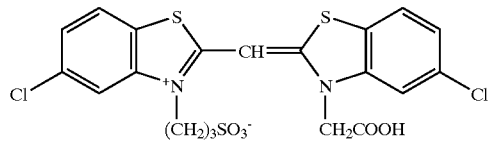

BS-2

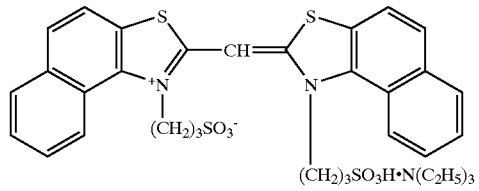

GS-1

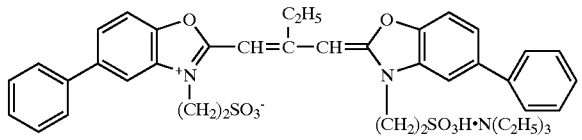

RS-1

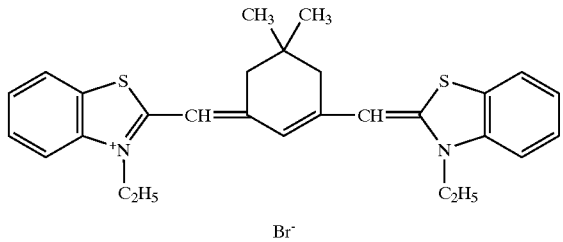

-continued

RS-2

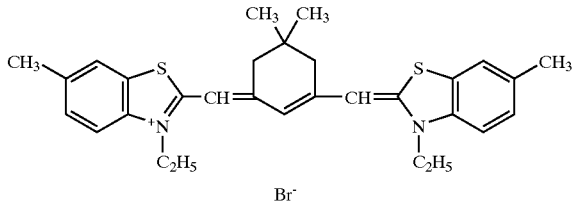

SS-1

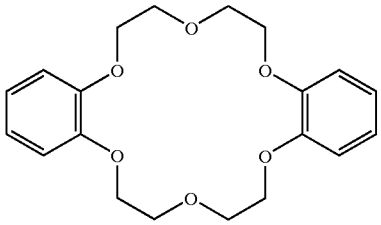

Preparation of Silver Halide Color Photographic Material

Preparation of Sample 101

There was prepared a paper support laminated, on the emulsion layer side of paper with a weight of 180 g/m$^2$, with high density polyethylene, provided that the emulsion layer side was laminated with polyethylene melt containing surface-treated anatase type titanium oxide in an amount of 15% by weight. This reflection support was subjected to corona discharge and provided with a gelatin sublayer, and further thereon, the following component layers, as shown below were provided to prepare a silver halide photographic material Sample 101. Hardeners (H-1) and (H-2) were incorporated into the 2nd, 4th and 7th layers. There were also incorporated surfactants, (SU-2) and (SU-3) to adjust surface tension. Antiseptic F-1 was further incorporated in an amount of 0.04 mg/m$^2$. The amount of silver halide contained in the respective layers was represented by equivalent converted to silver.

| Layer | Constitution | Amount (g/m$^2$) |
|---|---|---|
| 7th Layer (Protective layer) | Gelatin | 0.70 |
| | DIDP | 0.002 |
| | DBP | 0.002 |
| | Silicon dioxide | 0.003 |
| 6th Layer (UV absorbing layer) | Gelatin | 0.40 |
| | AI-1 | 0.01 |
| | UV absorbent (UV-1) | 0.07 |
| | UV absorbent (UV-2) | 0.12 |
| | Antistaining agent (HQ-5) | 0.02 |
| 5th Layer (Red-sensitive layer) | Gelatin | 1.00 |
| | Red-sensitive emulsion (Em-R1) | 0.17 |
| | Cyan coupler (C-1) | 0.22 |
| | Cyan coupler (C-2) | 0.06 |
| | Dye image stabilizer (ST-1) | 0.06 |
| | Antistaining agent (HQ-1) | 0.003 |
| | DBP | 0.10 |
| | DOP | 0.20 |
| 4th Layer (UV absorbing layer) | Gelatin | 0.94 |
| | AI-1 | 0.02 |
| | UV absorbent (UV-1) | 0.17 |
| | UV absorbent (UV-2) | 0.27 |
| | Antistaining agent (HQ-5) | 0.06 |

-continued

| Layer | Constitution | Amount (g/m$^2$) |
|---|---|---|
| 3rd Layer (Green-sensitive layer) | Gelatin | 1.30 |
| | AI-2 | 0.01 |
| | Green-sensitive Emulsion (Em-G1) | 0.12 |
| | Magenta coupler (M-1) | 0.05 |
| | Magenta coupler (M-2) | 0.15 |
| | Dye image stabilizer (ST-3) | 0.10 |
| | Dye image stabilizer (ST-4) | 0.02 |
| | DIDP | 0.10 |
| | DBP | 0.10 |
| 2nd layer (Interlayer) | Gelatin | 1.20 |
| | AI-3 | 0.01 |
| | Antistaining agent (HQ-1) | 0.02 |
| | Antistaining agent (HQ-2) | 0.03 |
| | Antistaining agent (HQ-3) | 0.06 |
| | Antistaining agent (HQ-4) | 0.03 |
| | Antistaining agent (HQ-5) | 0.03 |
| | DIDP | 0.04 |
| | DBP | 0.02 |
| 1st layer (Blue-sensitive layer) | Gelatin | 1.10 |
| | Blue-sensitive Emulsion (Em-B1) | 0.24 |
| | Yellow coupler (Y-1) | 0.10 |
| | Yellow coupler (Y-2) | 0.30 |
| | Yellow coupler (Y-3) | 0.05 |
| | Dye image stabilizer (ST-1) | 0.05 |
| | Dye image stabilizer (ST-2) | 0.05 |
| | Dye image stabilizer (ST-5) | 0.10 |
| | Antistaining agent (HQ-1) | 0.005 |
| | Image stabilizer A | 0.08 |
| | Image stabilizer B | 0.04 |
| | DNP | 0.05 |
| | DBP | 0.15 |
| Support | Polyethylene-laminated paper containing a small amount of colorant | |

Addenda used in the preparation of Sample 101 were as follows:

SU-1: Sodium tri-i-propylnaphthalenesulfonate

SU-2: Di(2-ethylhexyl)sulfosuccinate sodium salt

SU-3: 2,2,3,3,4,4,5,5-Octafluoropentyl sulfosuccinate sodium salt

DBP: Dibutyl phthalate

DNP: Dinonyl phthalate

DOP: Dioctyl phthalate

DIDP: Diisodecyl phthalate

H-1: Tetrakis(vinylsulfonylmethyl)methane

H-2: 2,4-Dichloro-6-hydroxy-s-triazine sodium salt

HQ-1: 2,5-Di-t-octylhydroquinone

HQ-2: 2,5-Di-sec-dodecylhydroquinone

HQ-3: 2,5-Di-sec-tetradecylhydroquinone

HQ-4: 2-sec-Dodecyl-5-sec-tetradecylhydoquinone

HQ-5: 2,5-Di-(1,1-dimethyl-4-hexyloxycarbonyl)-butylhydroqinone

Image stabilizer A: p-t-Octylphenol
Image stabilizer B: Poly(t-butylacrylamide)
Y-1
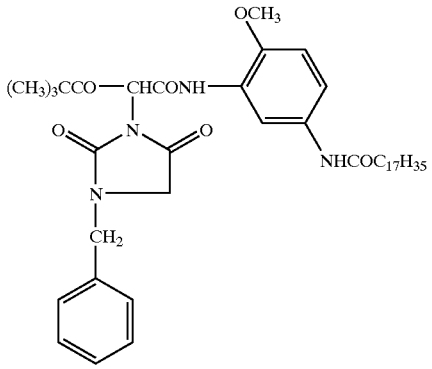
Y-2
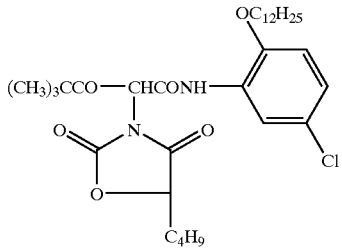
Y-3
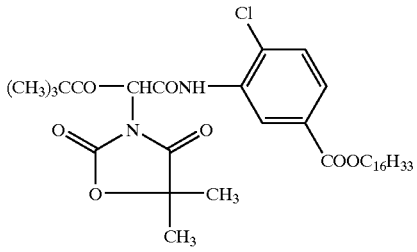
M-1
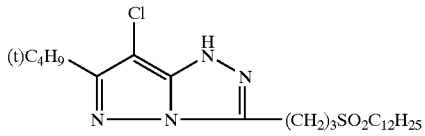
M-2
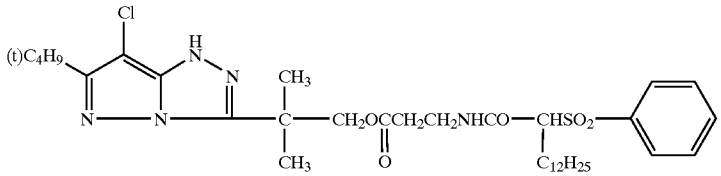
C-1
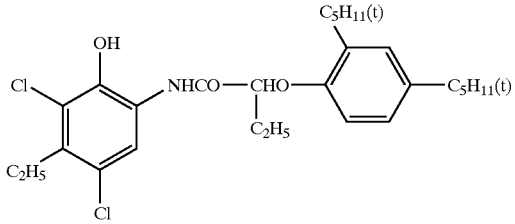
C-2
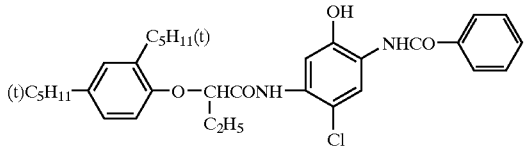
ST-1
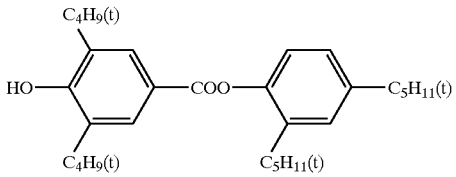
ST-2
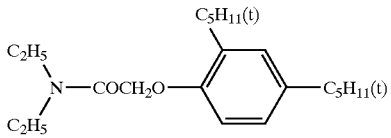
ST-3
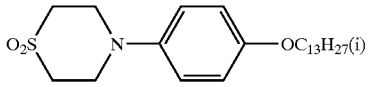
ST-4
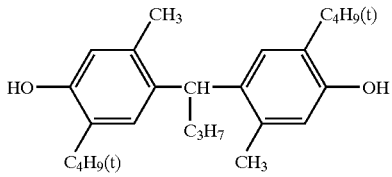

-continued

ST-5

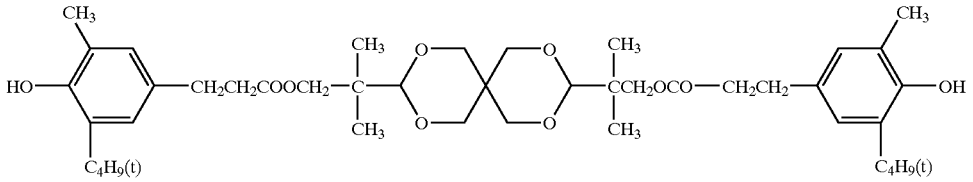

AI-1

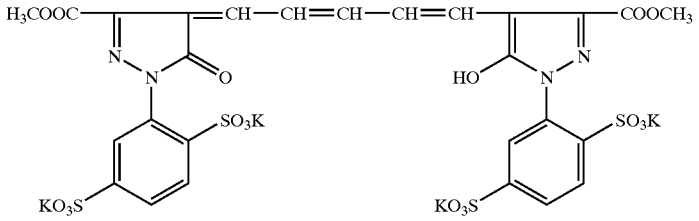

AI-2

AI-3

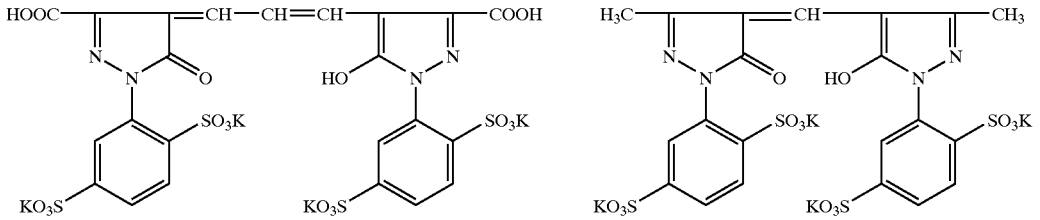

F-1

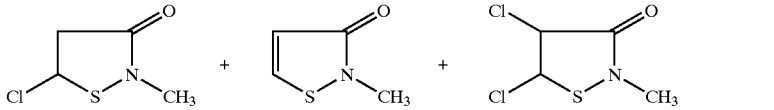

(50%) (46%) (4%) mole ratio

Mixture (molar ratio 50:46:4)

UV-1

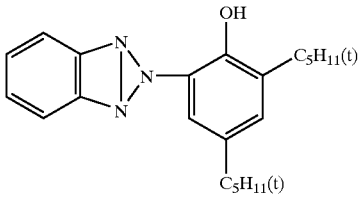

UV-2

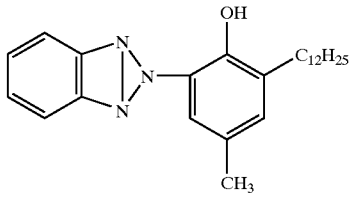

Determination of Effective Tone Range (VE) and ΔVE

The thus prepared Sample 101 was evaluated according to the following procedure (Evaluation A) to determine effective tone range (VE).

Evaluation S

The photographic material sample was subjected to scanning exposure using a semiconductor laser (oscillation wavelength of 650 nm), a He—Ne gas laser (oscillation wavelength of 544 nm) and an Ar gas laser (oscillation wavelength of 458 nm) as a light source. Using a scanning exposure apparatus which was so adjusted that overlap between rasters was 25%, each laser beam was allowed to conduct main-scanning onto the sample, while modulating the light amount by means of AOM, based on image data and allowing the beam to be reflected by a polygon mirror, and the photographic material sample was allowed to transport vertically to the main-scanning direction (sub-scanning). The photographic material was successively exposed so as to obtain 1 cm×1 cm square patches, while the main scanning was conducted with adjusting exposures of respective colors so that gray was stepwise reproduced from the minimum density to the maximum density. At 1 hr after completion of exposure, processing was carried out according to the following process 1. Respective steps of the thus obtained gray patch images were subjected to densitometry using densitometer PDA-65 (produced by Konica Corp.) to measure reflection densities. Then, a red light reflection density (D) vs. red laser light exposure amount (Log E), green light reflection density (D) vs. green laser light exposure amount (Log E) and blue light reflection density (D) vs. blue laser light exposure amount (Log E) for every step were plotted to obtain characteristic curves for respective colors. Subsequently, differential values of density (D) vs. exposure amount (Log E) for respective steps were calculated with respect to each of three colors to determine the exposure region exhibiting a point gamma of 1.0 or more (i.e., effective tone range VE). Further, the difference (ΔVE) between a VE value of an image forming layer having the maximum of the effective tone range (VE) values and that of an image forming layer having the minimum of the effective tone range (VE) values was determined. Furthermore, an average gradation over the range of reflection densities of 0.8 to 1.8 was also determined.

| Process 1 | | |
|---|---|---|
| Step | Temperature | Time |
| Color developing (CDC-1) | 37.0 ± 0.5° C. | 45 sec. |
| Bleach-fixing (BF-1) | 35.0 ± 2.5° C. | 45 sec. |
| Stabilizing | 35–39° C. | 45 sec. |
| Drying | 60–80° C. | 30 sec. |

Compositions of processing solutions are as follows.

| Color developer (CD-1) | |
|---|---|
| Water | 800 ml |
| Triethylenediamine | 2 g |
| Diethylene glycol | 10 g |
| Potassium bromide | 0.02 g |
| Potassium chloride | 4.5 g |
| Potassium sulfite | 0.25 g |
| N-ethyl-N(β-methanesulfonamidoethyl)-3-methyl-4-aminoaniline sulfate | 4.0 g |
| N,N-diethylhydroxyamine | 5.6 g |
| Triethanolamine | 10.0 g |
| Sodium diethyltriaminepentaacetate | 2.0 g |
| Potassium carbonate | 30 g |

Water is added to make 1 liter, and the pH is adjusted to 10.1 with sulfuric acid or potassium hydroxide.

| Bleach-fixer (BF-1) | |
|---|---|
| Water | 700 ml |
| Ammonium diethyltriaminepentaacetate dihydrate | 65 g |
| diethyltriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

| Stabilizer | |
|---|---|
| Water | 800 ml |
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| fluorescent brightener (Chinopal SFP) | 2.0 g |
| 1-Hydroxyethylidene-1,1-diphosphonic acid | 1.8 g |
| Magnesium sulfate heptahydrate | 0.2 g |
| Polyvinyl pyrrolidone | 1.0 g |
| Trisodium nitrilotriacetate | 1.5 g |

Water is added to make 1 liter, and the pH is adjusted to 7.5 with sulfuric acid or potassium hydroxide.

Preparation of Sample 102 through 107

Photographic material Samples 102 through 107 were prepared similarly to Sample 101, except that silver halide emulsion (Em-B1) used in the 1st layer, silver halide emulsion (Em-G1) used in the 3rd layer and silver halide emulsion (Em-R1) used in the 5th layer were each controlled with respect to chemical sensitization conditions (temperature, time, addition timing of additives, etc.) and the mixing ratio of emulsions so as to have effective tone range (VE) values, as shown in Table 1.

Evaluation of Silver Halide Color Photographic Material

The thus prepared Samples 101 through 107 were each evaluated, in addition to the foregoing evaluation S, according to the following evaluations A, B and C.

Evaluation A

Samples were subjected to exposure, processing and densitometry similarly to the foregoing evaluation S, provided that the time after completion of exposure and before start of processing was 1 min. An average gradation over the reflection density range of 0.8 to 1.8 was also determined.

Evaluation B

Similarly to evaluation A described above, exposure, processing and densitometry were carried out to determine an average gradation over the reflection density range of 0.8 to 1.8, provided that the exposure apparatus was replaced by a xenon flush sensitometer for high intensity exposure (SX-20 Type, available from YAMASHITA DENSO Co., Ltd.), in which exposure was optimally adjusted so as to give gray step images and conducted through an optical wedge for use in sensitometry, for $10^{-6}$ sec.

Evaluation C

In the exposure apparatus used in evaluation A, calibration operation was carried out so as to enable image output for all samples and after preparing LUT, print images including a character image and a 50% gray solid area were outputted.

Evaluation of Outputted Image 20 people visually evaluated respective print images obtained in evaluation C with respect to character reproduction (blackness, edge sharpness, and presence/absence of doubling of character fringes or blocking of reverse-text) and uniformity of solid areas (scanning exposure streaks and presence/absence of granular appearance). Better image quality was marked with higher scores (Maximum 100 points) and the average evaluation point of 20 people was calculated. A higher average point indicates superior character reproduction and improved scanning uniformity, leading to beautiful prints.

The thus obtained results, together with results obtained in Evaluation S are shown in Table 1 and 2.

TABLE 1

| | Effective Tone Range (VE) | | | | |
|---|---|---|---|---|---|
| Sample No. | Blue Density | Green Density | Red Density | ΔVE | Remark |
| 101 | 0.78 | 0.86 | 0.70 | 0.16 | Comp. |
| 102 | 0.78 | 0.82 | 0.71 | 0.11 | Inv. |
| 103 | 0.72 | 0.82 | 0.75 | 0.10 | Inv. |
| 106 | 0.72 | 0.77 | 0.75 | 0.05 | Inv. |
| 107 | 0.75 | 0.82 | 0.82 | 0.07 | Inv. |

TABLE 2

| Sample | Blue Density | | | Green Density | | | Red Density | | | C | |
|---|---|---|---|---|---|---|---|---|---|---|---|
| No. | S | A | B | S | A | B | S | A | B | (Score) | Remark |
| 101 | 3.32 | 3.19 | 3.17 | 3.08 | 2.89 | 2.84 | 3.59 | 3.49 | 3.47 | 55 | Comp. |
| 102 | 3.32 | 3.19 | 3.17 | 3.13 | 3.01 | 2.99 | 3.58 | 3.48 | 3.46 | 70 | Inv. |
| 103 | 3.58 | 3.45 | 3.43 | 3.14 | 3.03 | 3.01 | 3.55 | 3.43 | 3.41 | 75 | Inv. |
| 106 | 3.58 | 3.48 | 3.47 | 3.18 | 3.10 | 3.08 | 3.55 | 3.46 | 3.44 | 95 | Inv. |
| 107 | 3.43 | 3.34 | 3.32 | 3.11 | 3.01 | 2.99 | 3.47 | 3.38 | 3.36 | 90 | Inv. |

S Evaluation S
A Evaluation A
B Evaluation B
C Evaluation C

As can be seen from Tables 1 and 2, it was proved that samples meeting the requirement of the VE-value being not more than 0.84 resulted in reproduction of characters with sharp fringes and samples meeting the requirement of the ΔVE value being not more than 0.08 resulted in reduced doubling of character fringes, both of which gained high scores in evaluation C, leading to beautiful finished prints. It is specifically noted that Samples 106 and 107, which met both requirements, resulted in reduced variation in gradation even when the interval between exposure and development was varied, leading to stable print reproducibility.

Example 2

Samples 201 through 203 were prepared similarly to Samples 110, provided that except that silver halide emulsion (Em-B1) used in the 1st layer, silver halide emulsion (Em-G1) used the 3rd layer and silver halide emulsion (Em-R1) used in the 5th layer were each optimally controlled with respect to chemical sensitization conditions (temperature, time, addition timing of additives, amounts of stabilizers, etc.) and the mixing ratio of emulsions so as to have maximum point gamma values, as shown in Table 3. Effective tone range VE and maximum point gamma p−γ (max) were determined similarly to Example 1.

TABLE 3

| Sample | Effective Tone Range (VE) | | | Maximum Point Gamma [p-γ(max)] | | | VE/p-γ(max) | | | | |
|---|---|---|---|---|---|---|---|---|---|---|---|
| No. | B | G | R | B | G | R | B | G | R | *1 | Remark |
| 201 | 0.79 | 0.85 | 0.71 | 2.96 | 3.20 | 3.58 | 0.27 | 0.27 | 0.20 | 0.07 | Comp. |
| 202 | 0.72 | 0.75 | 0.81 | 4.03 | 4.00 | 3.77 | 0.18 | 0.19 | 0.21 | 0.04 | Inv. |
| 203 | 0.75 | 0.82 | 0.82 | 4.42 | 4.84 | 4.93 | 0.17 | 0.17 | 0.17 | 0.00 | Inv. |

*1 Δ(VE/p-γ(max))
B Blue Density
G Green Density
R Red Density

Similarly to Example 1, Samples 301 through 303 were evaluated in accordance with Evaluations A, B and C. Results thereof are shown in Table 4.

TABLE 4

| Sample | Blue Density | | | Green Density | | | Red Density | | | C | |
|---|---|---|---|---|---|---|---|---|---|---|---|
| No. | S | A | B | S | A | B | S | A | B | (Score) | Remark |
| 201 | 3.05 | 2.86 | 2.81 | 2.92 | 2.78 | 2.74 | 2.87 | 2.78 | 2.75 | 55 | Comp. |
| 202 | 3.58 | 3.48 | 3.46 | 3.18 | 3.09 | 3.06 | 3.55 | 3.44 | 3.41 | 85 | Inv. |
| 203 | 3.43 | 3.34 | 3.32 | 3.11 | 3.02 | 3.00 | 3.47 | 3.39 | 3.37 | 95 | Inv. |

S Evaluation S
A Evaluation A
B Evaluation B
C Evaluation C

As can be seen from Tables 3 and 4, it was proved that samples meeting the requirement of the VE/p−γ(max) value being 0.16 to 0.21 resulted in reproduction of characters with sharp fringe and a sample meeting the requirement of the Δ(VE/p−(max)) value being not more than 0.03 resulted in reduced doubling of character fringes, both of these samples gained high scores in Evaluation C, leading to beautiful finished prints. It is specifically noted that Sample 203, which met both requirements, resulted in reduced variation in gradation even when the interval between exposure and development was varied, leading to stable print reproducibility.

Example 3

Photographic material Sample 301 was prepared in the same manner as Sample 101 in Example 1. Samples 302 through 311 were prepared similarly to Sample 301, except that silver halide emulsion (Em-B1) used in the 1st layer, silver halide emulsion (Em-G1) used in the 3rd layer and silver halide emulsion (Em-R1) used in the 5th layer were each controlled with respect to chemical sensitization conditions (temperature, time, addition timing of additives, etc.) and the mixing ratio of emulsions so as to have effective tone range (VE) values, as shown in Table 5.

Evaluation of Silver Halide Color Photographic Material

The thus prepared Samples 101 through 107 were each evaluated according to the following evaluations A1 and B1.

Evaluation A1

Samples were exposed through an optical wedge for 0.5 sec. using a light source having a color temperature of 5400° K and processed similarly to Example 1. Stepped gray images, which were obtained similarly to Example 1 were measured with respect to reflection densities of blue, green and red, using a densitometer (PDA-65, available from Konica Corp.) to prepare a characteristic curve comprising abscissa of exposure (Log E) and an ordinate of reflection density (D) for each of three colors. Subsequently, differential values of density (D) vs. exposure (Log E) for respective steps were calculated to determine the maximum point gamma with respect to the respective colors.

Evaluation B1

Similarly to the foregoing Evaluation A1, exposure, processing and densitometry were carried out, provided that the exposure apparatus was replaced by a xenon flush sensitometer for high intensity exposure (SX-20 Type, available from YAMASHITA DENSO Co., Ltd.), in which exposure was optimally adjusted so as to give gray step images and conducted through an optical wedge for use in sensitometry, for $10^{-6}$ sec. Subsequently, differential values of density (D) vs. exposure (Log E) for respective steps were calculated to determine the maximum point gamma with respect to the respective colors. Furthermore, the exposure region exhibiting a point gamma of 1.0 or more (main tone range) was also determined.

Determination of ΔLog E

There was determined the difference in exposure between exposures (Log Ea, Log Ed) exhibiting the maximum point gamma on the characteristic curves obtained in the foregoing evaluation A1 and B1. Thus, when one of the characteristic curves was moved parallel to the abscissa so both curves are overlapped at the point of D=0.8, the difference was determined between the exposure (Log Ea) providing the maximum point gamma on the characteristic curve obtained in evaluation A1 and the exposure (Log Ed) providing the maximum. point gamma on the characteristic curve obtained in evaluation B1.

Evaluation of Digital Exposure Image

In the exposure apparatus used in evaluation B1, calibration operation was carried out so as to enable image output for all samples and after preparing LUT, print images including a character image or photograph-taken scenes (landscape and people photography) were outputted.

20 people visually evaluated respective print images obtained in evaluation C with respect to character reproduction (blackness, edge sharpness, and presence/absence of doubling of character fringes or blocking of reverse-text) and uniformity of a solid area (scanning exposure streaks and presence/absence of granular appearance). Better image quality was marked at higher scores (Maximum 100 points) and the average point of 20 people was calculated. Higher average point indicates superior character reproduction and improved scanning uniformity, leading to beautiful prints.

Evaluation of Analog Exposure Image

Using negative film in which pictures including a character image or photograph-taken scenes (landscape and people photography) were taken, printing exposure was performed in minilab system NPS 858 (produced by Konica Corp.) to prepare prints. The prepared prints were evaluated similarly to the case of digital exposure.

The thus obtained results are shown in Table 5

TABLE 5

| Sample No. | ΔLogE | Effective Tone Range (VE) Blue Density | Green Density | Red Density | ΔVE | Image Evaluation Digital Exp. | Analog Exp. | Average | Remark |
|---|---|---|---|---|---|---|---|---|---|
| 301 | 0.15 | 0.78 | 0.87 | 0.70 | 0.17 | 50 | 80 | 65 | Comp. |
| 305 | 0.08 | 0.78 | 0.82 | 0.71 | 0.11 | 75 | 88 | 82 | Inv. |
| 306 | 0.05 | 0.72 | 0.82 | 0.75 | 0.10 | 80 | 84 | 82 | Inv. |
| 310 | 0.04 | 0.72 | 0.77 | 0.75 | 0.05 | 90 | 92 | 91 | Inv. |
| 311 | 0.04 | 0.75 | 0.82 | 0.82 | 0.07 | 90 | 90 | 90 | Inv. |

As can be seen from Table 5, it was proved that Samples exhibiting ΔLog E of not more than 0.1 resulted in favorable images in both analog and digital exposures.

Example 4

Similarly to Example 3, Samples 301, 305 and 306 were further evaluated with respect to digital exposure image and analog exposure image, provided that the pH and temperature of the color developer solution were respectively changed to 10.50 and 39.0±0.5° C. and the developing time was varied from 45 sec. 15 sec. Results thereof are shown in Table 6.

TABLE 6

| Sample No. | ΔLogE | Developing Time (sec) | Image Evaluation Digital Exp. | Analog Exp. | Average | Remark |
|---|---|---|---|---|---|---|
| 301 | 0.15 | 45 | 50 | 80 | 65 | Comp. |
| 301 | 0.16 | 15 | 35 | 73 | 54 | Comp. |
| 305 | 0.08 | 45 | 75 | 88 | 82 | Inv. |
| 306 | 0.05 | 45 | 80 | 84 | 82 | Inv. |
| 305 | 0.09 | 15 | 74 | 86 | 80 | Inv. |
| 306 | 0.06 | 15 | 80 | 82 | 81 | Inv. |

As can be seen from Table 6, it was proved that Sample 301 resulted in deteriorated image quality in digital exposure when the developing time was shortened. On the contrary, Samples 305 and 306 exhibiting loge of not more than 0.1 resulted in no deteriorated image even when the developing time was shortened, providing stable and beautiful images over the broad exposure time range of extremely short exposure to conventional exposure.

What is claimed is:

1. A silver halide color photographic material comprising a support having thereon color image forming layers comprising at least a yellow image forming layer, at least a magenta image forming layer and at least a cyan image forming layer, each of which contains light sensitive silver halide, wherein when the photographic material having been exposed to light so that an exposure time per pixel is $10^{-10}$ to $10^{-3}$ sec., each of the yellow, magenta cyan image forming layers after being processed meets the following requirement (1):

$$0.65 \leqq VE \leqq 0.84 \quad (1)$$

wherein VE represents an effective tone range.

2. The photographic material of claim 1, wherein each of the yellow, magenta cyan image forming layers after being processed meets the following requirement (2):

$$0 \leqq \Delta VE \leqq 0.08 \quad (2)$$

wherein ΔVE represents a difference between the maximum value of effective tone ranges and the minimum value thereof.

3. The photographic material of claim 1, wherein each of the yellow, magenta cyan image forming layers meets the following requirement (3):

$$0.16 \leqq VE/p\text{-}\gamma(\max) \leqq 0.21$$

wherein p−γ(max) represents a maximum point gamma value.

4. The photographic material of claim 3, wherein the photographic material meets the following requirement (4):

$$0 \leqq \Delta[VE/p\text{-}\gamma(\max)] \leqq 0.03$$

wherein Δ[VE/p−γ(max)] represents a difference between a maximum VE/p−γ(max) value and a minimum VE/p−γ (max) value.

5. The photographic material of claim 1, wherein each of the yellow, magenta and cyan image forming layers meets the following requirement (5):

$$\Delta \text{Log } E \leqq 0.1$$

wherein ΔLog E is a difference between a logarithmic exposure giving a maximum point gamma value when exposed so that an exposure time is $10^{-6}$ sec per pixel and a logarithmic exposure giving a maximum point gamma value when exposed so that an exposure time is 0.5 sec per pixel.

6. The photographic material of claim 1, wherein at least one the of the yellow, magenta and cyan image forming layers contains a compound represented by the following formula (1):

Formula (1)

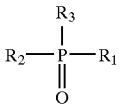

wherein $R_1$, $R_2$ and $R_3$ are each a substitute group.

7. The photographic material of claim 1, wherein the photographic material is subjected to color development over a period of not more than 25 sec.

* * * * *